US008678764B1

(12) United States Patent
Kimmel

(10) Patent No.: US 8,678,764 B1
(45) Date of Patent: Mar. 25, 2014

(54) TIP CAP FOR A TURBINE ROTOR BLADE

(75) Inventor: Keith D Kimmel, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 964 days.

(21) Appl. No.: 12/606,463

(22) Filed: Oct. 27, 2009

(51) Int. Cl.
*F01D 5/14* (2006.01)

(52) U.S. Cl.
USPC ..... 416/62; 416/228

(58) Field of Classification Search
USPC ..... 416/62, 146 R, 189, 228, 232, 241 R; 29/889.2, 889.21
See application file for complete search history.

(56) References Cited

U.S. PATENT DOCUMENTS

| | | | | |
|---|---|---|---|---|
| 2,971,743 | A * | 2/1961 | Welsh | 416/191 |
| 3,002,675 | A * | 10/1961 | Howell et al. | 417/352 |
| 4,519,745 | A * | 5/1985 | Rosman et al. | 416/96 A |
| 5,269,057 | A * | 12/1993 | Mendham | 29/889.1 |
| 7,744,346 | B2 * | 6/2010 | Schreiber et al. | 416/62 |
| 8,100,653 | B2 * | 1/2012 | Gerakis et al. | 416/97 R |

* cited by examiner

*Primary Examiner* — Nathaniel Wiehe
*Assistant Examiner* — Sean J Younger
(74) *Attorney, Agent, or Firm* — John Ryznic

(57) ABSTRACT

A turbine rotor blade with a spar and shell construction, and a tip cap that includes a row of lugs extending from a bottom side that form dovetail grooves that engage with similar shaped lugs and grooves on a tip end of the spar to secure the tip cap to the spar against radial displacement. The lug on the trailing edge end of the tip cap is aligned perpendicular to a chordwise line of the blade in the trailing edge region in order to minimize stress due to the lugs wanting to bend under high centrifugal loads. A two piece tip cap with lugs at different angles will reduce the bending stress even more.

8 Claims, 4 Drawing Sheets

TIP CAP FOR A TURBINE ROTOR BLADE

GOVERNMENT LICENSE RIGHTS

This invention was made with Government support under contract number DE-FG02-07ER84668 awarded by Department of Energy. The Government has certain rights in the invention.

CROSS-REFERENCE TO RELATED APPLICATIONS

This application is related to co-pending U.S. Regular patent application Ser. No. 12/486,179 entitled MULTIPLE PIECE TURBINE BLADE the entire specification being incorporated herein by reference.

BACKGROUND OF THE INVENTION

1. Field of the Invention

The present invention relates generally to a gas turbine engine, and more specifically to an air cooled turbine rotor blade with a spar and shell construction.

2. Description of the Related Art Including Information Disclosed Under 37 CFR 1.97 and 1.98

A gas turbine engine, such as an industrial gas turbine (IGT) engine, compresses air that is then burned with a fuel to produce a high temperature gas flow, which is then passed through a turbine having multiple rows or stages or stator vanes and rotor blades to power and aircraft or, in the case of the IGT, drive an electric generator. It is well known in the art of gas turbine engine design that the efficiency of the engine can be increased by passing a higher gas flow temperature through the turbine. However, the turbine inlet temperature is limited by the material properties of the turbine, especially for the first stage airfoils since these are exposed to the highest temperature gas flow. As the gas flow passes through the various stages of the turbine, the temperature decreases as the energy is extracted by the rotor blades.

Another method of increases the turbine inlet temperature is to provide more effective cooling of the airfoils. Complex internal and external cooling circuits or designs have been proposed using a combination of internal convection and impingement cooling along with external film cooling to transfer heat away from the metal and form a layer of protective air to limit thermal heat transfer to the metal airfoil surface. However, since the pressurized air used for the airfoil cooling is bled off from the compressor, this bleed off air decreases the efficiency of the engine because the work required to compress the air is not used for power production. It is therefore wasted energy as far as producing useful work in the turbine.

Recently, airfoil designers have proposed a new air cooled turbine rotor blade or stator vane design that is referred to as a spar and shell airfoil. U.S. Pat. No. 7,080,971 issued to Wilson et al. on Jul. 25, 2006 and entitled COOLED TURBINE SPAR SHELL BLADE CONSTRUCTION discloses one of these latest airfoils, the entire disclosure being incorporated herein by reference. The spar and shell construction allows for the use of a shell that can be made from an exotic high temperature alloy or material such as tungsten, molybdenum or columbium that could not be used in the prior art investment casting blades or vanes. Airfoils made from the investment casting technique are formed from nickel superalloys and as a single piece with the internal cooling circuitry cast into the airfoil. Film cooling holes are then drilled after the airfoil has been cast. Without much improvement in the cooling circuitry of these investment cast nickel super-alloy airfoils, the operating temperature is about at its upper limit.

Thus, these new spar and shell airfoils will allow for the shell to be formed from the exotic high temperature materials because the shell can be formed using a wire EDM process to form a thin wall shell, and then the shell is supported by a spar to form the blade or vane. The exotic high temperature metals such as tungsten, molybdenum or columbium cannot be cast using the investment casting process because of there very high melting temperatures. However, thin walled shells can be formed using the wire EDM process. With a spar and shell airfoil having a shell made from one of these materials, the operating temperature can be increased way beyond the maximum temperature for an investment cast airfoil. Thus, the engine turbine inlet temperature can be increased and the engine efficiency increased.

One major problem with these new spar and shell rotor blades is securing the shell to the blade assembly without inducing too high of a stress level on the blade spar or tip section. Since the rotor blade rotates in the engine, high stress levels are formed on the blade parts that form the blade assembly. In some designs, the blade tip is formed as part of the spar to maintain low stress levels. In some designs, the blade tip is a separate piece from the spar and therefore must be attached to the spar while securing the shell to the blade assembly. Because the blade assembly must be supplied with cooling air to provide cooling for the shell, the spar must include at least one central passage for supplying the cooling air to the blade assembly. This hollow spar can result in less metal material in the tip region for the tip cap to be secured to the spar. High stress levels have been observed in computer modeling of various designs for the tip cap and spar connection.

BRIEF SUMMARY OF THE INVENTION

It is an object of the present invention to provide for a turbine rotor blade of the spar and shell construction with a tip cap as a separate piece from the main spar.

It is another object of the present invention to provide for a turbine rotor blade of the spar and shell construction dovetail grooves and slots to secure the tip cap to the spar and hold the shell in place.

It is another object of the present invention to provide for a turbine rotor blade of the spar and shell construction with a tip cap having a dovetail slot and groove construction that results in a minimal stress level to in the dovetail grooves.

It is another object of the present invention to provide for a turbine rotor blade of the spar and shell construction with a relatively low stress level in the blade tip cap to spar connection.

These objectives and more can be achieved by the turbine rotor blade with the spar and shell construction dovetails and slots formed in the tip end of the spar and the bottom side of the tip cap so that the tip cap can be slid into place to secure the shell to the spar. The slots and dovetail grooves extend across the airfoil from the leading edge to the trailing edge and are parallel to each other. The slot and groove closest to the trailing edge of the airfoil—which is the thinnest part of the airfoil—are perpendicular to the airfoil chordwise line in order to significantly reduce any bending of the tip cap trailing edge lugs due to centrifugal loads.

DETAILED DESCRIPTION OF THE INVENTION

The present invention is an air cooled turbine rotor blade that has a spar and shell construction. The shell is a thin walled shell to provide for relatively low metal temperature due to backside convection and impingement cooling, the shell being secured to the spar by a number of hooks extending from the shell that prevent bulging of the shell due to high cooling air pressure in channels formed between the spar and the shell, to produce a seal between adjacent cooling channels formed between the shell and the spar, and to allow for a relatively large metal surface in the tip region for attaching a separate tip cap to the spar while maintaining low stress levels at the tip section during rotor blade rotation.

Figure 1:
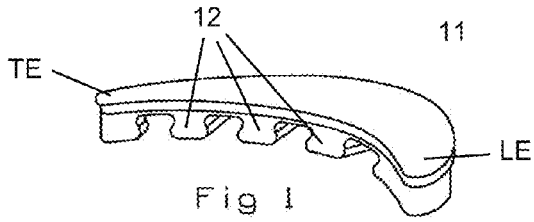
FIG. 1 shows an isometric view of a one piece tip cap of the present invention.

FIGS. 1 through 4 shows the turbine rotor blade of the first embodiment of the present invention with FIG. 1 showing a tip cap 11 with several rows of lugs 12 extending from the bottom of the tip cap 11 and forming dovetail slots between the lugs 12. The tip cap 11 includes a leading edge (LE) lug and a trailing edge (TE) lug both on the ends of the tip cap and other lugs in-between these end lugs that form a row of dovetail slots that are each parallel to one another.

Figure 2:
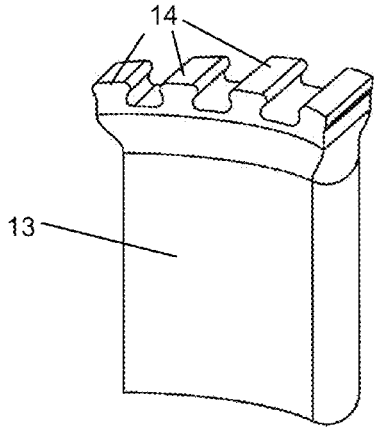
FIG. 2 shows an isometric view of a spar with dovetail slots on the tip end of the present invention.

FIG. 2 shows a tip end of the spar 13 and include lugs 14 that extend upward from the tip end and form dovetail slots in-between the lugs 14. The dovetail slots in the tip end of the spar 13 are also parallel to one another. The lugs and the dovetail slots in both the tip cap and the spar are sized and shaped so that the tip cap can be slide into place on the tip end of the spar to secure the tip cap against radial displacement with respect to the spar and thus secure the shell 15 in place to form the rotor blade assembly.

Figure 4:
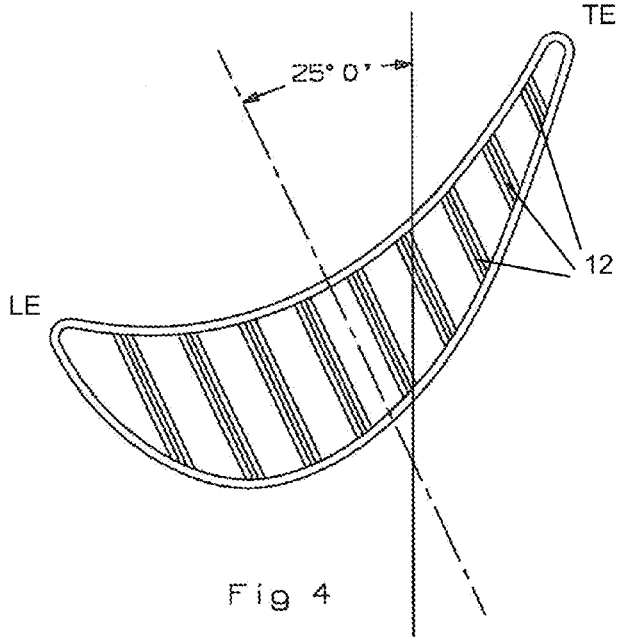
FIG. 4 shows a cross section view from the top of the tip cap with the angled slots of the present invention.
Figure 3:
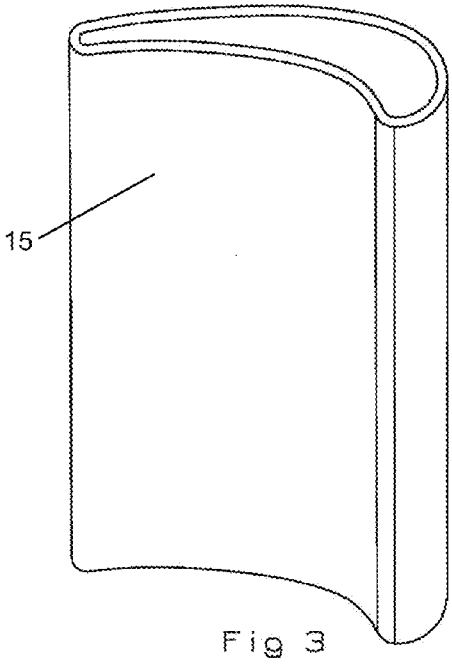
FIG. 3 shows an isometric view of a shell for the spar and shell blade of the present invention.
Figure 5:
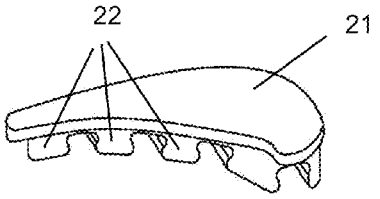
FIG. 5 shows an isometric view of a one piece tip cap of a second embodiment of the present invention.
Figure 6:
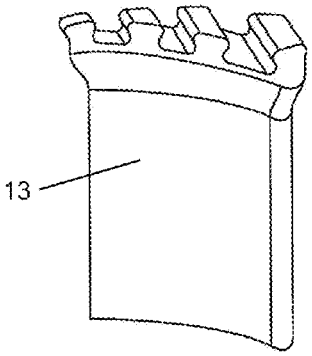
FIG. 6 shows an isometric view of a spar with dovetail slots on the tip end of a second embodiment of the present invention.

FIG. 3 shows the shell 15 that is secured between a platform and root section of the blade assembly (not shown) and the underside of the tip cap 11 when the tip cap 11 is secured to the tip end of the spar 13. FIG. 4 shows a key feature of the present invention in that the lugs that form the dovetail grooves in the tip cap and the spar are angled at 25 degrees with respect to a circumferential direction of the rotor blade assembly that is shown as a vertical line in FIG. 4. The circumferential direction of the rotor blade assembly is the direction of rotation of the blade within the turbine of the engine.

The lugs and grooves are offset at this angle (25 degrees) in order to more evenly distribute bending and minimize stress concentrations across the TE lug sectional area that occurs within the TE lug and groove when the rotor blade is rotating and the centrifugal loads act to pull the tip cap 11 away from the spar 13. The cross sectional shape of the airfoil will vary and so will the offset angle of the lugs from the chordwise line of the airfoil. The TE end of the tip cap is the thinnest portion of the tip cap, and thus the sectional area of the lug and groove is the smallest at the TE end. Because the lug at the TE end has the least cross-sectional area, this part of the tip cap is more sensitive to non-uniform bending than the other lugs and grooves in the remaining portions of the tip cap and spar due to the centrifugal loads. Therefore, to minimize the stress levels due to the tip cap lugs wanting to bend due to the centrifugal loads, the angle of the lugs and the grooves is offset from the circumferential direction by the 25 degrees in order to more evenly distribute load across the TE lug since it is most sensitive to bending, as seen in FIG. 4.

Figure 8:
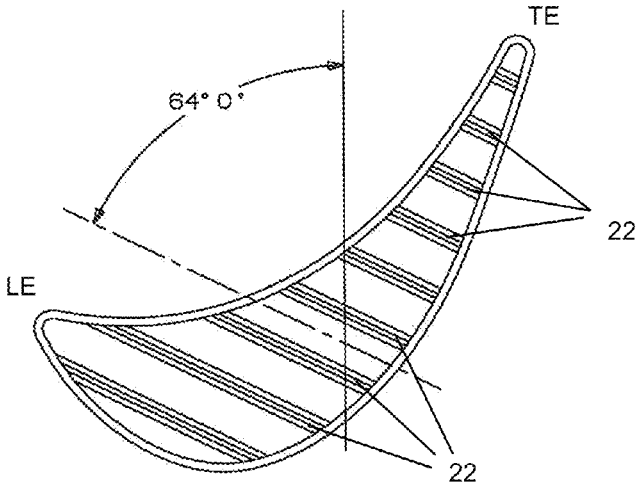
FIG. 8 shows a cross section view from the top of the tip cap with the angled slots of a second embodiment of the present invention.
Figure 7:
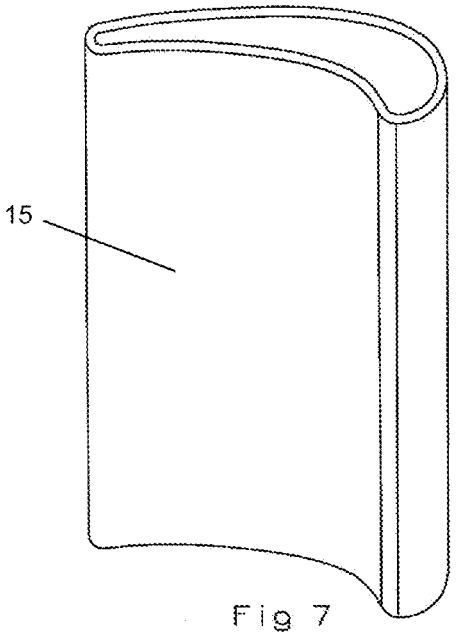
FIG. 7 shows an isometric view of a shell for the spar and shell blade of a second embodiment of the present invention.
Figure 9:
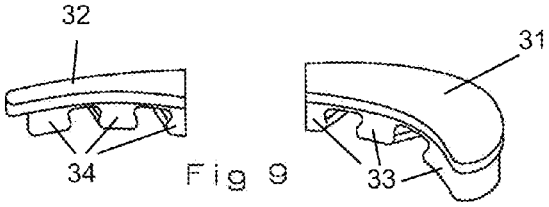
FIG. 9 shows an isometric view of a two piece tip cap of a third embodiment of the present invention.
Figure 10:
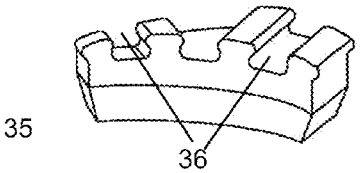
FIG. 10 shows an isometric view of a tip end of a spar with dovetail slots on the tip end of a third embodiment of the present invention.

From computer modeling of the first embodiment of FIGS. 1 through 4 above, the applicant has discovered that the angle of the lugs 22 in the tip cap 21 of the second embodiment shown in FIGS. 5 through 8 would produce a minimal amount of stress from bending of the lugs if the TE most lug was perpendicular to the camber line of the airfoil in the trailing edge region. The camber line runs from the leading edge to the trailing edge as passes through a middle section of the airfoil. The tip cap and spar structure of the FIGS. 5 through 8 embodiments are the same as in the FIGS. 1 through 4 embodiments except that the angle of the lugs and grooves are offset from the circumferential direction by 64 degrees. In the second embodiment of FIG. 8, the lugs and grooves are offset at the 64 degrees so that the lug at the TE end is perpendicular to the camber line of the airfoil at the TE region as seen in FIG. 8. When the lug and groove on the TE end is perpendicular to the camber line, the bending stress that result in the TE lug and groove as a result of the centrifugal loads is purely radial and thus evenly distributed along the TE sectional area, eliminating stress concentration due to non-uniform bending. However, with the embodiment of FIGS. 5 through 8, the lugs and grooves in the forward section of the airfoil will still suffer from stress concentrations due to non-uniform bending of the lugs but would be within acceptable limits.

Figure 12:
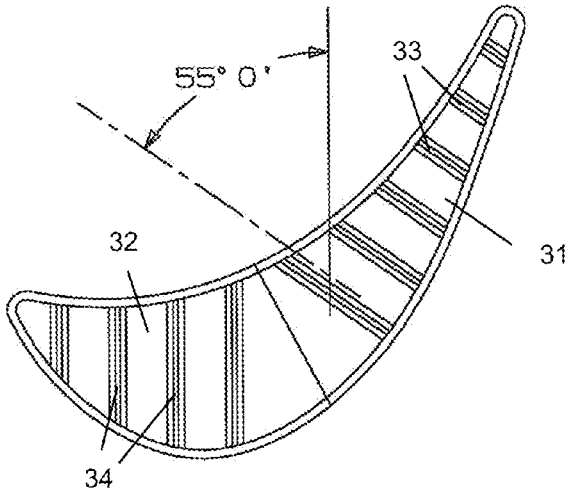
FIG. 12 shows a cross section view from the top of the tip cap with the angled slots of a third embodiment of the present invention.
Figure 11:
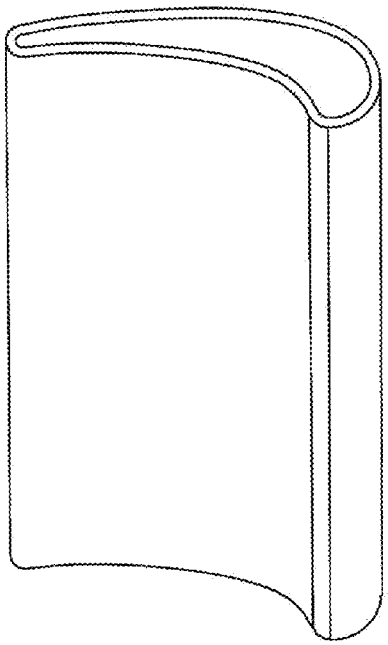
FIG. 11 shows an isometric view of a shell for the spar and shell blade of a third embodiment of the present invention.

One method of minimizing the stress levels that occur in the lugs and grooves due to bending is in the third embodiment shown in FIGS. 9 through 12 in which a two piece tip cap is used. The two piece tip cap includes a forward or LE tip cap piece 31 and an aft or TE tip cap piece 32 that together form a full tip cap for the spar and shell blade. The spar is still a one piece spar 35 but with two sets of grooves 36 to conform to the lugs 33 and 34 that extend from the underside of the two tip cap pieces 31 and 32. FIG. 12 shows the arrangement of the lugs and grooves in the two tip cap pieces. The TE tip cap piece 31 has the lugs 33 extending perpendicular to the camber line of the airfoil in the TE region so as to eliminate any bending stress concentrations from non-uniform centrifugal loads tending to pull the tip cap away from the spar. In this embodiment, the TE tip cap lugs 33 are offset at 55 degrees from the circumferential direction of the blade. The lugs 33 in FIG. 12 are not offset at 64 degrees like in FIG. 8 (at 64 degrees the lugs are perpendicular to the camber line at the trailing edge end of the airfoil) but at 55 degrees so that the lugs 33 do not interest with the lugs 34 at the fat point of the airfoil (represented by the tip cap dividing line in FIG. 12).

The LE tip cap piece 32 has the lugs 34 parallel to a rotational direction of the airfoil as seen in FIG. 12 so as to minimize the lug and groove stress due to the bending forces developed from the high centrifugal loads. Since the TE end of the tip cap is the narrowest, the lugs in the TE end of the tip cap and the spar grooves are the most sensitive to uneven load distribution. Since the LE end of the tip cap is wider, this section is less sensitive to higher force loads because the stress is spread out over larger areas than in the TE section. The two piece tip cap allows both the LE and TE lugs in the tip cap to undergo even load distribution, thus minimizing stress concentrations in the two smallest cross-sectional areas of the tip cap.

One other benefit to the two piece tip cap shown in FIGS. 9 through 12 is that the lugs on the TE piece slant toward the lugs on the LE piece as seen in FIG. 12. The lugs slant toward a point of convergence that is on the pressure side wall of the blade as opposed to the suction side wall. This will allow for any rubbing of the tip cap against a shroud surface of the turbine to produce a force to push the tip cap pieces toward the suction wall side and lock the tip cap pieces to the spar even more than without rubbing.

Figure 13:
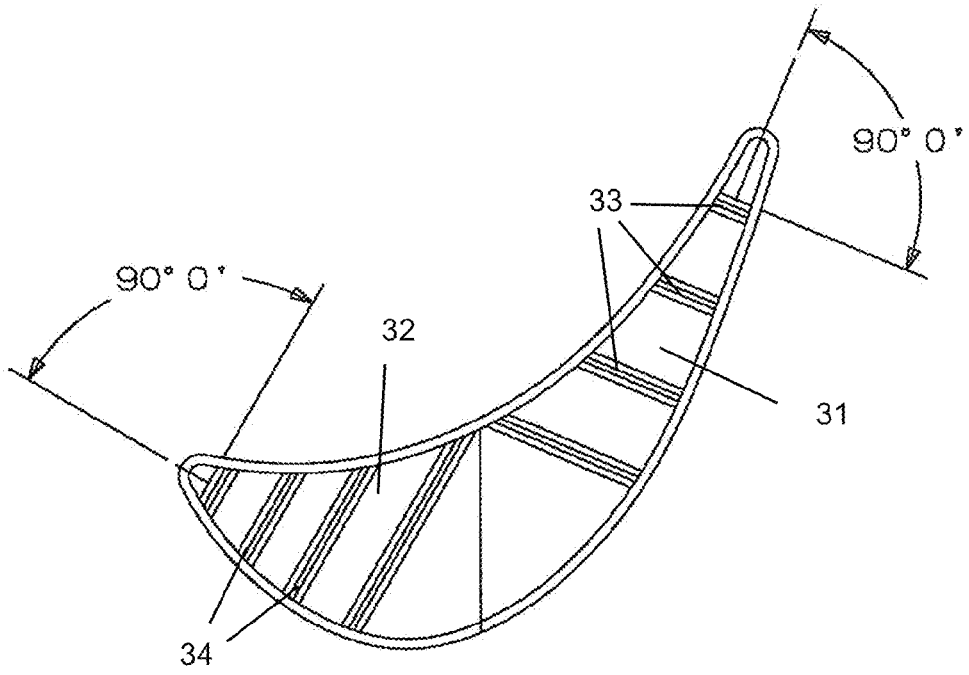
FIG. 13 shows a cross section view from the top of the tip cap with angled slots of a fourth embodiment of the present invention.

FIG. 13 shows another embodiment of the two piece tip cap with a variation of the two piece tip cap in FIG. 12 in which the lugs 34 on the LE tip cap piece are also perpendicular to the airfoil camber line in the LE region. This will eliminate the stress from bending of the lugs in the LE piece as was achieved in the TE piece of the FIG. 12 embodiment. In FIG. 13, the lugs 33 and 34 on both tip cap pieces 31 and 32 will be perpendicular to the camber line passing through that particular tip cap piece, for the end-most lug of each of the two pieces.

In all of the embodiments of the present invention discussed above, the tip caps and the spars can be cast or machined to form the finished part. Or, the part can be cast and then the lugs or grooves can be machined to form the finished part. The shell is to be made from an exotic high temperature resistant metal such as tungsten or molybdenum or columbium (Niobium) using a wire EDM process to produce a thin wall shell. However, the tip cap and the spar can be made from conventional nickel super alloys for ease of casting or machining

I claim the following:

1. A turbine rotor blade comprising:

a spar having a tip end with a row of lugs that form dovetail grooves;

a tip cap with a bottom side having a row of lugs that form dovetail grooves;

the lugs of the tip cap engage the grooves of the spar to secure the tip cap against radial displacement with respect to the spar; and, the lug and the groove in a trailing edge end of the tip cap are perpendicular to a camber line extending along the blade in the trailing edge region of the blade.

2. The turbine rotor blade of claim 1, and further comprising:

the lug and the groove in the trailing edge end is offset from a circumferential direction of the blade.

3. The turbine rotor blade of claim 2, and further comprising:

the offset is around 64 degrees.

4. The turbine rotor blade of claim 2, and further comprising:

the tip cap is a single piece tip cap; and, the lugs of the tip cap from the leading edge end to the trailing edge end are parallel to one another.

5. A turbine rotor blade comprising:

a spar having a tip end with a row of lugs that form dovetail grooves;

a tip cap with a bottom side having a row of lugs that form dovetail grooves;

the lugs of the tip cap engage the grooves of the spar to secure the tip cap against radial displacement with respect to the spar; and, the tip cap is a two piece tip cap with a leading edge tip cap piece and a trailing edge tip cap piece;

the lugs in the trailing edge tip cap piece are parallel to one another;

the lugs in the leading edge tip cap piece are parallel to one another; and, the lugs in the trailing edge piece and the lugs in the leading edge piece are angled such that they converge on a pressure side of the tip cap.

6. The turbine rotor blade of claim 5, and further comprising:

the lugs on the trailing edge piece are almost perpendicular to a camber line extending along the blade in the trailing edge region of the blade; and, the lugs on the leading edge piece are parallel to a circumferential direction of the blade.

7. The turbine rotor blade of claim 5, and further comprising:

the lugs on the trailing edge piece are offset from a circumferential direction of the blade at an angle of around 55 degrees.

8. The turbine rotor blade of claim 5, and further comprising:

the lugs on the trailing edge piece are perpendicular to a camber line of the airfoil at the trailing edge end; and, the lugs on the leading edge piece are perpendicular to a camber line of the airfoil at the leading edge end.

* * * * *